US005961771A

United States Patent [19]

Jurisich

[11] Patent Number: 5,961,771

[45] Date of Patent: Oct. 5, 1999

[54] CHEMICAL MILLING APPARATUS

[75] Inventor: Milne Jurisich, Runaway Parade, Australia

[73] Assignee: Melanesia International Trust Company Limited, Port Vila, Vanuatu

[21] Appl. No.: 08/765,617

[22] PCT Filed: Jun. 27, 1995

[86] PCT No.: PCT/AU95/00375

§ 371 Date: Dec. 27, 1996

§ 102(e) Date: Dec. 27, 1996

[87] PCT Pub. No.: WO96/00315

PCT Pub. Date: Jan. 14, 1996

[30] Foreign Application Priority Data

Jun. 27, 1994 [AU] Australia ..... PM6470

[51] Int. Cl.[6] ..... C23F 1/04

[52] U.S. Cl. ..... 156/345

[58] Field of Search ..... 216/83, 84, 109, 216/96, 100, 108; 156/345

[56] References Cited

U.S. PATENT DOCUMENTS

| | | | |
|---|---|---|---|
| 2,849,299 | 8/1958 | Young | 41/43 |
| 3,673,094 | 6/1972 | Kreml | 252/79.4 |
| 3,808,065 | 4/1974 | Robinson et al. | 156/2 |
| 4,239,586 | 12/1980 | Ghez et al. | 156/644 |

FOREIGN PATENT DOCUMENTS

| | | |
|---|---|---|
| 338114 | 10/1989 | European Pat. Off. . |
| 62-279641 | 12/1987 | Japan . |
| 2073253 | 10/1981 | United Kingdom . |
| WO93/10279 | 5/1993 | WIPO . |

*Primary Examiner*—Donna Wortman
*Assistant Examiner*—Brenda G. Brumback
*Attorney, Agent, or Firm*—Workman, Nydegger & Seeley

[57] ABSTRACT

A method of chemical milling which includes the following steps: (i) suspending an extrusion or casting formed from metal in an etching solution wherein initially the extrusion or casting is fully submerged in the etching solution by virtue of its weight and which thereafter is rendered buoyant by metal being removed from the extrusion or casting by the etching solution wherein the casting or extrusion is supported by a non-buoyant support which maintains the casting or extrusion in a fully submerged condition throughout its immersion in the etching solution; and (ii) withdrawing the extrusion or casting from the etching solution when required. The invention also refers to chemical milling apparatus for use in the abovementioned method as well as the non-buoyant support per se.

23 Claims, 10 Drawing Sheets

CHEMICAL MILLING APPARATUS

FIELD OF THE INVENTION

THIS INVENTION relates to chemical milling apparatus and method and is suitably directed to chemical milling or etching of metal articles formed from aluminium or other suitable metal such as heat exchanger elements which may be formed by extrusion or casting. Such elements are usually formed from "primary structure" in contrast to heat exchanger elements which are formed from "secondary structure" which may include additional components welded or otherwise attached to the "primary structure".

BACKGROUND OF THE INVENTION

Heat exchanger elements formed from primary structure are considered to be more thermally efficient than fabricated heat exchanger elements which constitute "secondary structure" and which may include a number of boundaries constituted by welds or joins. Thus not only is there a possibility of fluid leaks occurring in relation to these boundaries but also such boundaries provide zones of resistance to conduction of heat to heat transmission surfaces of the heat exchanger element.

Heat exchanger elements formed from primary structure are well known and reference may be made for example to U.S. Pat. Nos. 3,202,212; 4,565,244; 3,743,252; 4,352,008; 3,566,959; 4,567,074; 3,137,785 and 3,467,180 which all show that formation of one piece extrusions as heat exchanger elements are not new.

Reference, however, may be made to GB Patent 2,142,129 which describes a heat exchanger element or core which was incorporated in a radiator for use in a central heating system. The heat exchanger element was in the form of a rectangular elongate hollow body which is provided on each of the opposite sides with a plurality of spaced heat radiating fins. However, in this reference, there was no particular use described of the heat exchanger element per se and reference was only made to a radiator incorporating the heat exchanger element. The radiator included a cover plate which extended across the free ends of each set of fins so as to provide a plurality of open ended channels through which air could flow which air was heated by a transfer of heat from a hot fluid which could flow through the rectangular hollow body. This reference also describes an embodiment using a multiplicity of rectangular hollow sections. In such embodiment, to form the radiator, each hollow section had to be welded to each other and the terminal hollow sections provided with cover plates.

A heat exchanger comprising a plurality of modules each having a plurality of channels spaced from each other and located in a central body part and also a plurality of fins extending outwardly on each side of the central body part is also described in U.S. Pat. No. 4,401,155.

Of particular interest, in relation to the present invention, is the chemical milling of aluminium extrusions of the type described in GB Patent 2,142,129. Thus, the invention is concerned particularly with the chemical milling of aluminium heat exchanger elements having an elongate hollow body bounded by a peripheral wall and also having a plurality of fins extending outwardly from the peripheral wall. However, it will be appreciated by the skilled addressee that the chemical milling apparatus and method may also be applied to other heat exchanger elements having different shapes as hereinafter described and which, for example, are described in the prior art aluminium extrusions referred to above.

In this regard, it is useful in relation to heat exchanger elements, to be able to carry out a chemical milling or etching process so as to reduce the weight of metal which therefore provides a lighter heat exchanger element.

Reference may be made to "The Chem-Mill Design Manual" prepared by the Chem-Mill and Coatings Division of Turco Industries Inc in the United States which provides basic information on chemical milling processes and describes that the essential requirement of conventional chemical milling processes is to provide the fabrication of light weight metal parts of high strength which before the advent of chemical milling were either prohibitively expensive or impossible to manufacture using conventional mechanical processes.

In the above publication, chemical milling is defined as a process used to shape metals to an exacting tolerance by the chemical removal of metal or deep etching of parts rather than by the use of conventional mechanical, milling or machining operations.

The advantage of chemically milling a metal article, such as a heat exchanger element, is to remove metal chemically so that the heat exchanger element may be shaped to a desired shape or tolerance. The amount of metal removed or the depth of etch is controlled by the time of immersion in an etching solution. The location of unetched or unmilled areas on the element may be controlled by masking or protecting these areas from the action of the etchant solution.

The etchant solution which is mainly used in conventional chemical milling or metal etching is a strong acid or a strong base which dissolves in a controlled manner all surfaces it comes into contact with.

However, a particular problem occurs in relation to etching of aluminium extrusions when such extrusions have a specialised, awkward or other shape which may render the extrusion buoyant in an etching solution. An example of such shape is when the external surface area is substantially in excess of the internal surface area and this may be exemplified by a heat exchanger element having an elongate hollow body and a plurality of outwardly extending fins as described above. The problem is the difficulty of maintaining the heat exchanger element submerged within the etchant solution during the etching process. In this regard, such a heat exchanger element as described above may initially sink to the bottom of an etchant vessel but as milling continues, a chemical reaction occurs at the aluminium surface of the extrusion whereby aluminium will be dissolved. Subsequently, the extrusion will have a tendency to float and thus become a buoyant body and therefore rise upwardly in the etchant solution to the surface. This problem creates considerable difficulties in regard to providing a continuous etching process so as to etch the aluminium extrusion to the required extent.

SUMMARY OF THE INVENTION

It therefore is an object of the invention to provide chemical milling apparatus and an associated method so as to alleviate or inhibit the abovementioned problem.

The method of the invention includes the following steps:

(i) suspending an extrusion or casting formed from metal in an etching solution wherein initially the extrusion or casting is fully submerged in the etching solution by virtue of its weight and which thereafter is rendered buoyant by metal being removed from the extrusion or casting by the etching solution wherein the extrusion or casting is supported by a non-buoyant support which maintains the extrusion or casting in a fully submerged condition throughout its immersion in the etching solution; and (ii) withdrawing the extrusion or casting from the etching solution when required.

The main factor causing the extrusion or casting to rise without the non-buoyant support is the extreme chemical reaction in the etching vessel which produces an aerated solution whereby hydrogen gas is evolved in the etching solution and bubbles of hydrogen gas (or other gas which is dependent on the etchant chemicals used) rise to the surface of the etching solution. A pressure may be generated in the etching solution of the order of 50 p.s.i. if the etching vessel has an open top or of the order of 100 p.s.i. if the etching vessel is provided with a cover or lid. In this latter situation the etching vessel may be provided with vents so as to allow the hydrogen gas to escape from the etching vessel.

Suitably, extrusions or castings which may be chemically milled by the method of the invention have a surface area relative to mass of between 794 sq mm per g and 1323 sq mm per g.

In this regard, it will be appreciated that the process of the invention may be applied to aluminium extrusions having an external area which is substantially in excess of an internal area. This may be exemplified by the extrusion comprising an elongate hollow body and a plurality of radiating fins as described above. However, it will be appreciated that the process of the invention will be applicable to any shape of extrusion or casting which may render the extrusion or casting buoyant in an etching process.

Examples of other shapes include tubular shapes wherein the extrusion or casting has an outer wall and one or more inner walls which are all concentric with respect to each other. The extrusion or casting may also be plate-like in shape having a plurality of spaced ribs or comprise a corrugated plate or sheet. The process of the invention may also be applicable to an aluminium casting or an extrusion or casting made of a metal other than aluminium which undergoes a chemical reaction during a milling process.

The invention also includes, within its scope, the aforementioned support which, for example, in one example embodiment, supports the abovementioned casting or extrusion so that the fins are all aligned substantially vertically in the etching vessel.

Preferably, the support has primary engagement means for engaging with a top part or end portion of the casting or extrusion and also secondary engagement means for engaging with a bottom part or end portion of the extrusion or casting. Suitably, each of the primary engagement means and secondary engagement means are adjustable relative to the support so as to be able to engage with extrusions or castings of different lengths. To this end, each of the primary engagement means and the secondary engagement means are releasably attached to an elongate rod and are therefore movable toward or away from each other. In an alternative embodiment, one of the primary engagement means or the secondary engagement means may be fixed to the elongate rod and the other of the primary engagement means or secondary engagement means is releasably attached to the elongate rod. The elongate rod may also have a handle attached thereto at an upper end in use.

In a particularly preferred form, both the primary engagement means and the secondary engagement means are provided with one or more engagement finger(s) which may engage with an adjacent open end of the hollow body. In this arrangement, both the primary engagement means and the secondary engagement means may be provided a pair of engagement fingers which engage with the said adjacent open end.

In a particular arrangement, one or both of the primary engagement means and the secondary engagement means may include a central sleeve which is attached to the elongate rod and a plurality of mounting arms extending outwardly from the central sleeve wherein each of the mounting arms have a plurality of offset projections and which may constitute an engagement finger as described above. The central sleeve in relation to one or both of the primary engagement means and the secondary engagement means may be slidably attached to the elongate rod and may also be rotatable relative to the elongate rod and suitably locking means may be provided to lock the central sleeve in a desired position to the elongate rod such as a grub screw or other form of adjustable locking member.

The invention also includes within its scope, chemical milling apparatus for suspending one or more extrusions or castings in an etching solution so as to retain the extrusion(s) or casting(s) in a fully submerged position in said etching solution, said chemical milling apparatus including a conveyor belt to which is attached one or more non-buoyant supports for supporting a corresponding extrusion or casting.

BRIEF DESCRIPTION OF THE DRAWINGS

Reference may now be made to a preferred embodiment of the invention as shown in the attached drawings wherein.

DETAILED DESCRIPTION

Figure 1A:
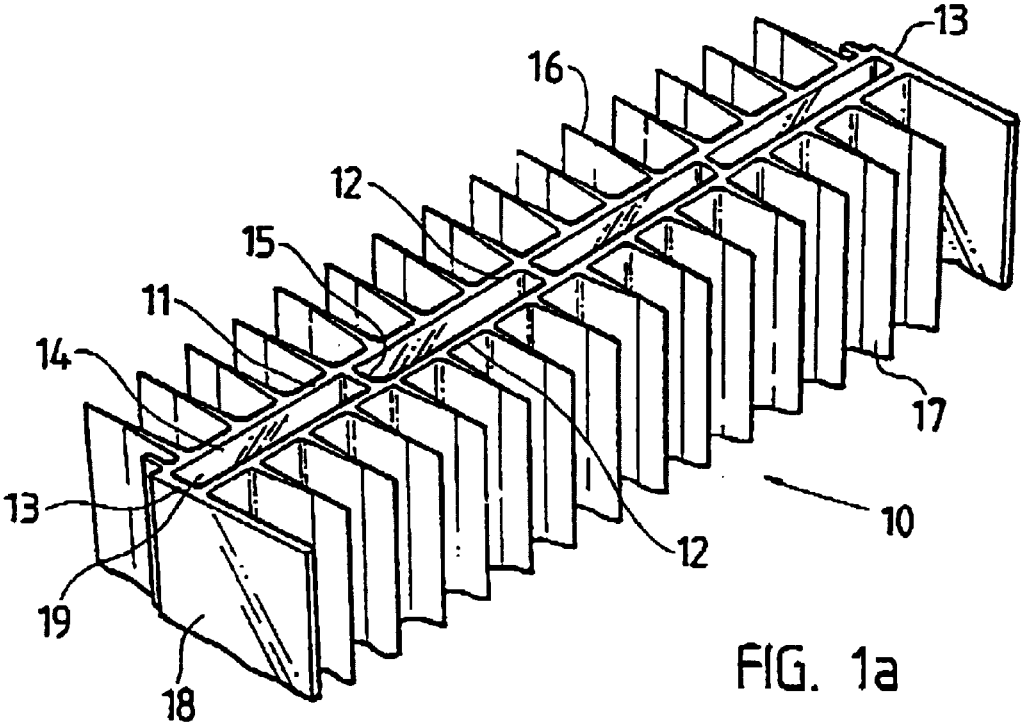
FIG. 1*a* is a perspective view of an aluminium extrusion which may be chemically milled by the process and apparatus of the invention.
Figure 1B:
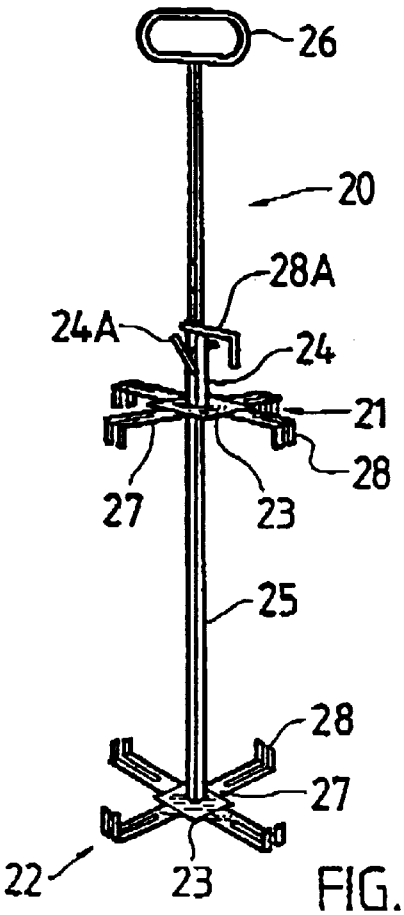
FIG. 1*b* is a perspective view of a support for holding the aluminium extrusion of FIG. 1*a* in an etching vessel as described herein.

The aluminium extrusion 10 in FIG. 1*a* includes a peripheral wall 11 of shallow rectangular configuration which has opposed side parts 12 and opposed end parts 13. The peripheral wall 11 which is of a continuous nature defines a plurality of fluid channels 14 separated by partitions or webs 15. There is also included a first array of fins 16 extending away from one side part 12 and a second array of fins 17 extending away from the opposed horizontal part 12. End walls 18 may also be included. Fluid channels 14 may also be provided with open ends 19.

In FIG. 2, the support 20 which is constructed in accordance with the invention includes primary engagement means in the form of a top clamp 21 and secondary engagement means in the form of a bottom clamp 22. Each clamp 21 includes a central mounting plate 23. Attached to top mounting plate 23 is a central sleeve or hub 24 through which may be inserted a locking pin 24A which may be inserted through co-aligned apertures (not shown) in sleeve 24 and upright shaft or rod 25. Locking pin 24 may also be replaced by a grub screw or other suitable locking member as desired. Rod 25 may also be provided with an upper handle 26 Each clamp 21 and 22 may also include a plurality of horizontal arms 27 each of which at their outer free end may include offset projections or engagement fingers 28 Sleeve 24 also has handle 28A.

Figure 1C:
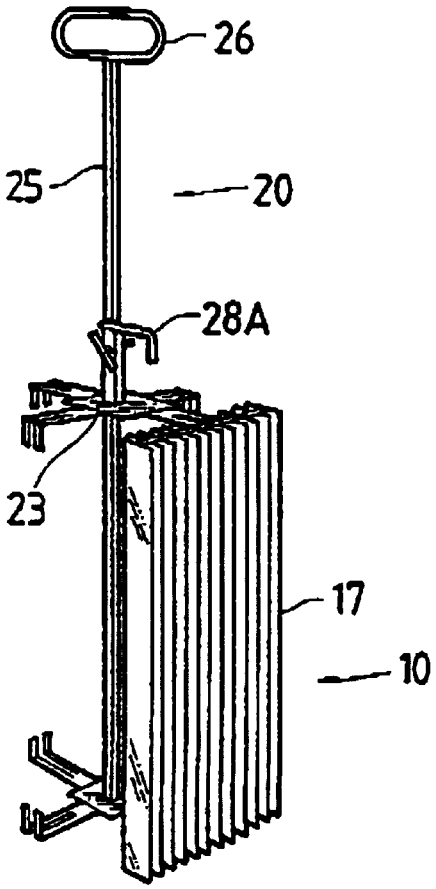
FIG 1*c* is a perspective view of the support of FIG. 1*b* holding the aluminium extrusion of FIG. 1*a* for subsequent immersion in an etching vessel.

As shown in FIG. 1*c*, extrusion 10 is supported by support 20 with fins 16 and 17 oriented vertically.

Figure 2A:
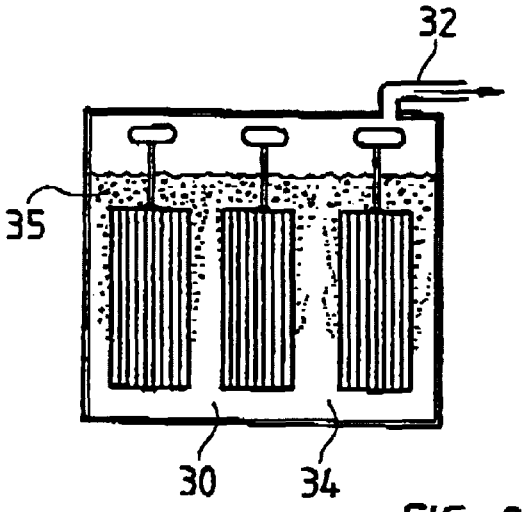
FIG. 2*a* represents the aluminium extrusion of FIG. 1 being held by the support of FIG. 2 in an etching vessel which is vented to atmosphere.
Figure 2B:
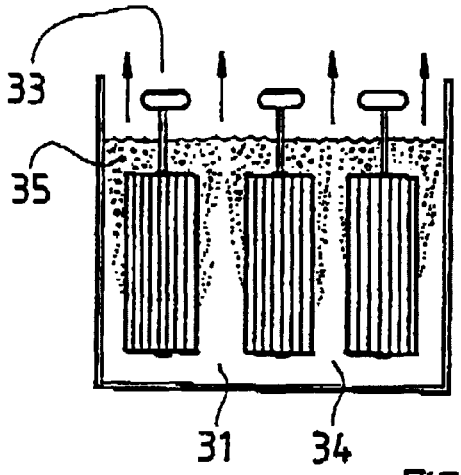
FIG. 2*b* is a similar view to FIG. 2*a* wherein the etching vessel has an open top.

In FIGS. 2*a*–2*b*, there is provided etching vessels 30 and 31 wherein etching vessel 30 is provided with vent 32 for passage of escaping gases or whereby etching vessel 31 is provided with an open top 33. The etchant 34 is shown reacting with the aluminium of the extrusion 10 causing the aluminium to be dissolved in the etchant 34 with the evolution of bubbles 35 of hydrogen gas.

Without the agency of support 20, each of extrusions 10 shown in FIGS. 2*a*–2*b* would rise to the surface and thus would be rendered buoyant by the reaction between the etchant and the aluminium.

Figure 3A:
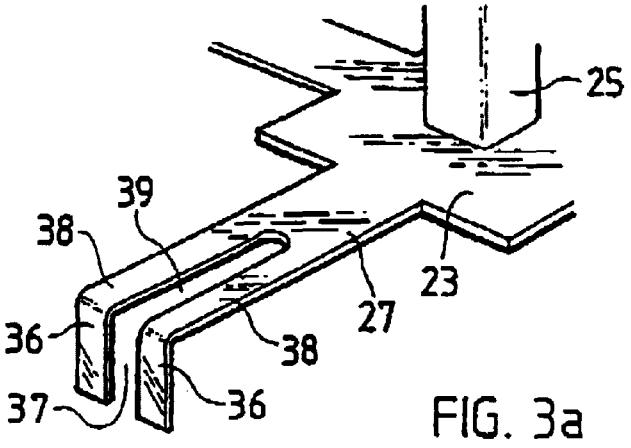
FIGS. 3*a*–3*d* represent various forms of the engagement fingers as hereinbefore described.
Figure 3B:
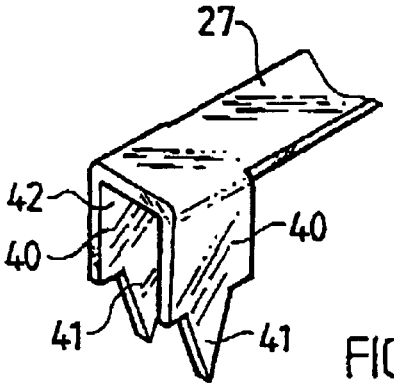

FIGS. 3*a*-3*b* show the various types of offset projections or engagement fingers 28 that may be utilised with horizontal arms 27. In FIG. 3*a*, there is provided a pair of offset spaced projections 36 separated by a gap 37. Projections 36 are extensions of parts 38 of arm 27 which parts are also separated by gap. 39.

In FIG. 3*b*, there are provided spaced and opposed offset projections 40 each having a pointed end 41. Projections 40 may be separated by gap 42.

Figure 3D:
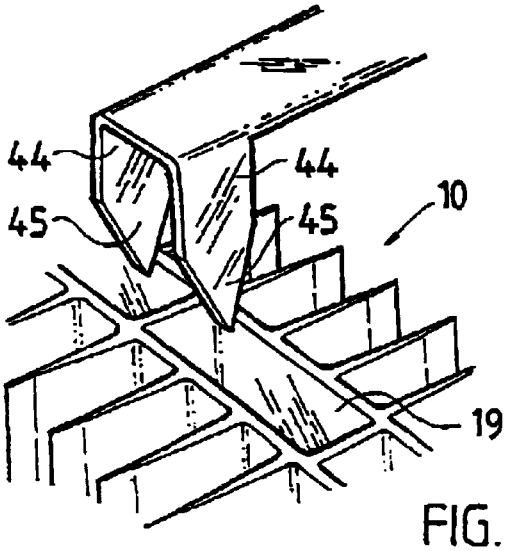
Figure 3C:
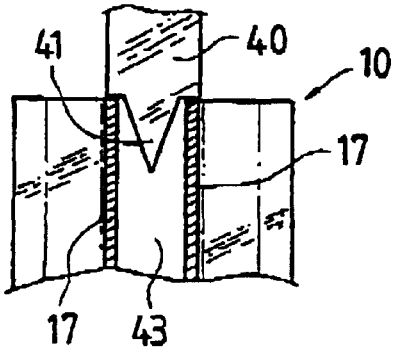

In FIG. 3*c*, the engagement of projections 40 in the spaces 43 between adjacent fins 17 is also shown.

In FIG. 3*d*, arm 27 may be provided with opposed lugs or offset projections 44 which may engage with an adjacent open end 19 of fluid passages 14 of extrusion 10 whereby projections 44 each having a pointed end 45 may engage on either side of web 15.

Figure 4A:
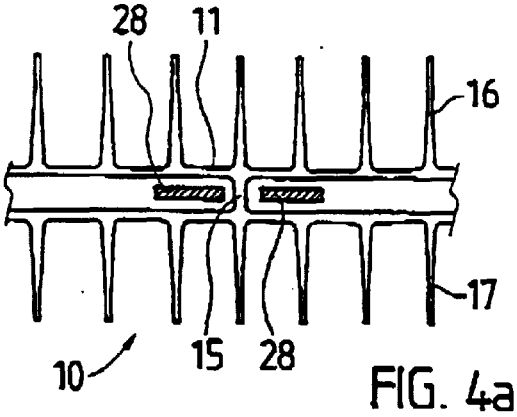
FIGS. 4*a*–4*d* represents various means by which the engagement fingers of FIGS. 3*a*–3*d* may engage with the aluminium extrusion of FIG. 1*a*.
Figure 4B:
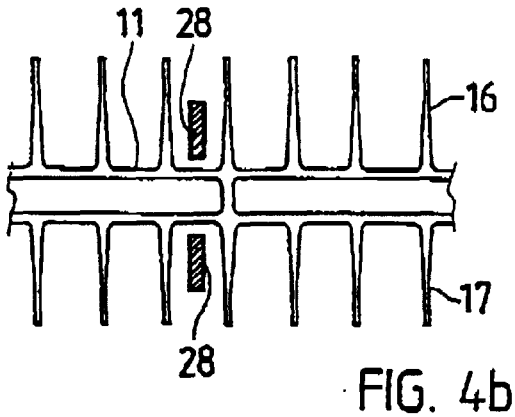
Figure 4C:
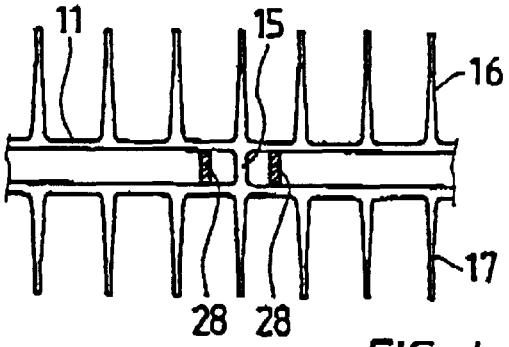
Figure 4D:
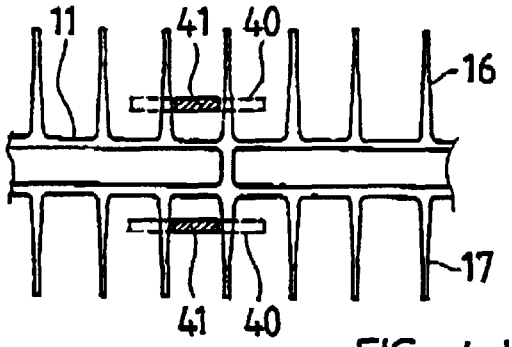

In FIGS. 4*a*–4*d*, it will be noted that fingers 28 may engage on either side of web 15 in FIG. 4*a*, between adjacent fins 16 and 17 and thus on both sides of wall 11 as shown in FIG. 4*b*, again on either side of web 15 as shown in FIG. 4*c*, or as shown in FIG. 4*d* where pointed ends 41 may be located between adjacent fins 17 on opposed sides of peripheral wall 11. FIG. 4*d* shows essentially the same arrangement as shown in PIG. 3*c*.

Figure 5A:
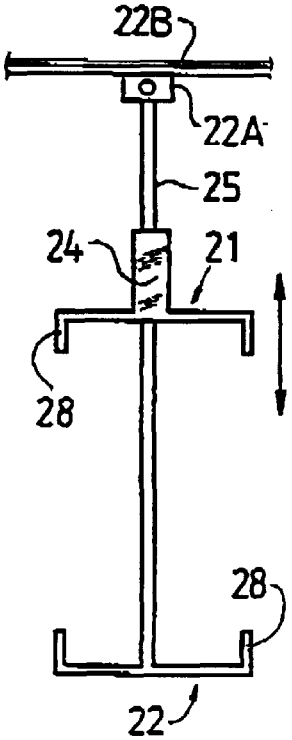
FIGS. 5*a*–5*i* represent various forms of supports which may be utilised in the process and apparatus of the invention.
Figure 5B:
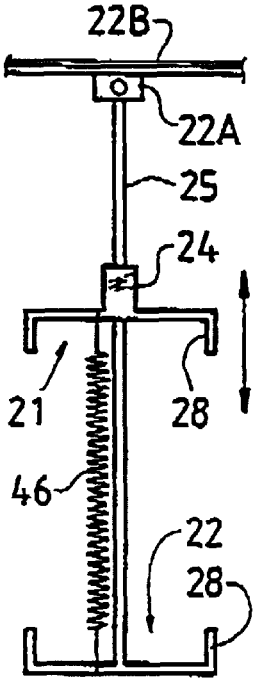
Figure 5C:
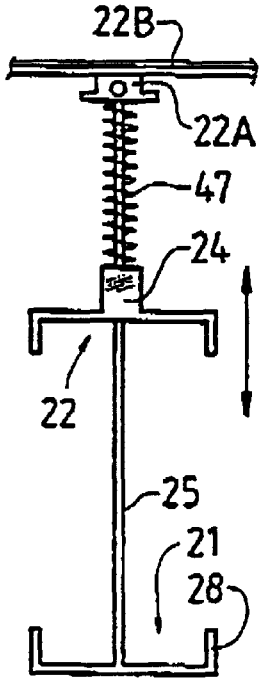
Figure 5D:
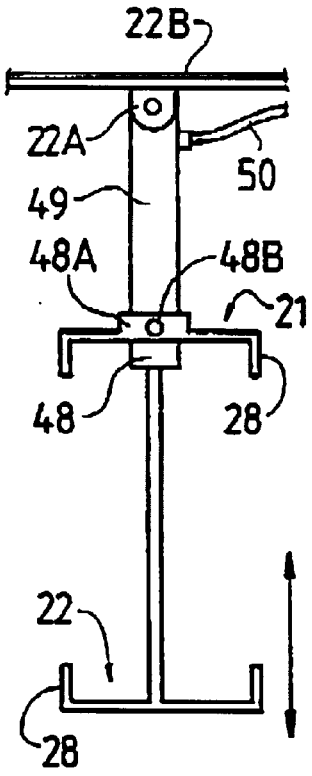

In FIGS. 5*a*–5*i*, the construction of clamps 21 and 22 may take many different forms. In each case, the support 20 may be pivotally attached by pivot joint 22A to a conveyor belt 22B described hereinafter in FIG. 7. In FIG. 5*a*, bottom clamp 22 is fixed while top clamp 21 is movable toward and away from clamp 22 as shown by the doubled headed arrow. In FIG. 5*b*, a tension spring 46 may be inserted between clamps 21-22 as shown. Alternatively in FIG. 5*c*, a compression spring 47 may be inserted between clamp 22 and pivot joint 22A. In FIG. 5*d*, clamp 22 may be part of a piston 48 movable toward or away from fixed cylinder 49 having clamp 21 attached thereto. Clamp 22 may be attached to cylinder 49 by attachment sleeve 48A having associated therewith grub screw 48B. Hose 50 may also be provided for passage of pressurised air or hydraulic fluid from a suitable source (not shown).

Figure 5E:
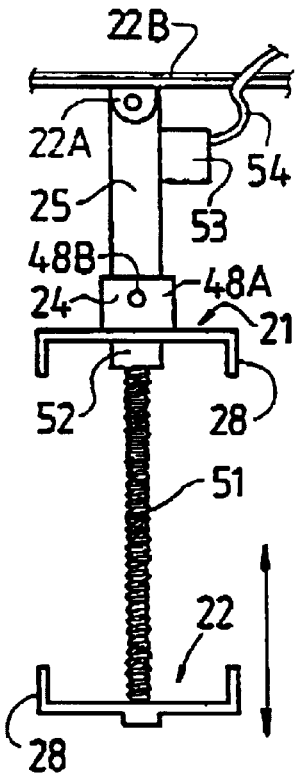

In FIG. 5*e*, bottom clamp 22 may be attached to a worm gear 51 whereby bottom clamp 22 may move toward or away from housing 52 by movement of worm gear 51 which is controlled by motor 53 having power cable 54.

Figure 5F:
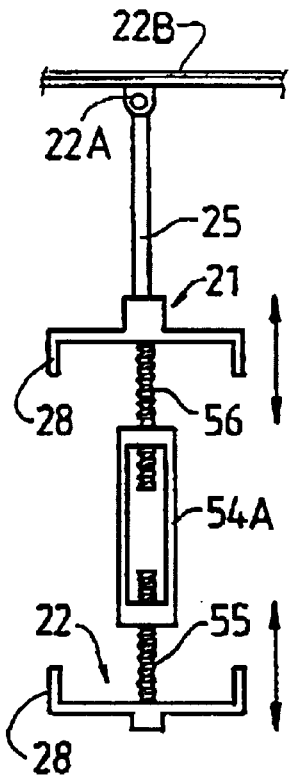

In FIG. 5*f*, there is shown a turnbuckle arrangement 54A whereby either top clamp 21 or bottom clamp 22 is movable toward or away from each other as shown. In this arrangement, bottom clamp 22 is attached to a screw threaded shaft 55 of a different thread to screw threaded shaft 56 to which is attached clamp 21.

Figure 5G:
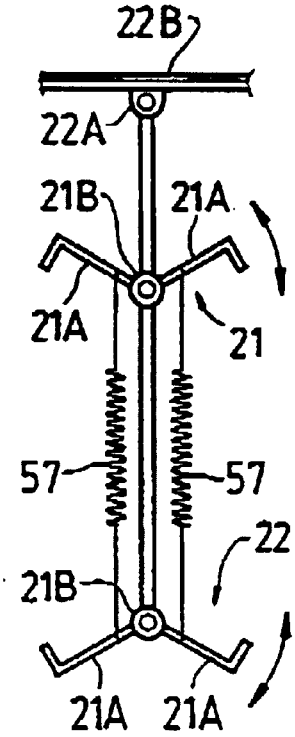

In FIG. 5*g*, both top clamp 21 and bottom clamp 22 comprise a pair of pivoted arms 21A which are pivoted to pivot joints 21B. There is also provided tension springs 57 which interconnect each of arms 21A as shown. Tension springs 57 may also be replaced by a screw threaded equivalent or a pneumatic/hydraulic equivalent if desired. The arrangement shown in FIG. 5*g* may therefore provide a support 20 which can accommodate a pair of extrusions 10 of different lengths. In another variation, either of bottom clamp 22 or top clamp 21 may be fixed if desired.

Figure 5H:
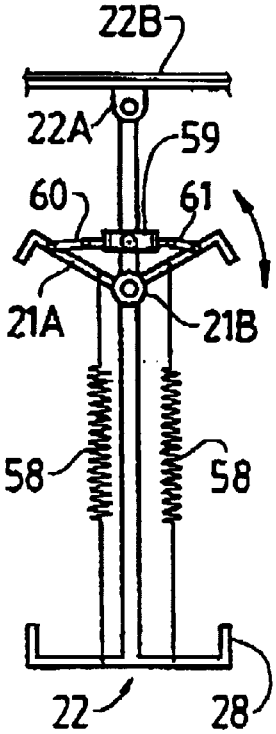

In FIG. 5*h*, bottom clamp 22 is fixed and top clamp 21 comprises pivoted arms 21A attached to pivot joint 21B. There is also provided springs 58 which may be dispensed with if desired. There is also provided solenoid valve 59 which may initiate movement of arms 21A through pivot links 60 and 61.

Figure 5I:
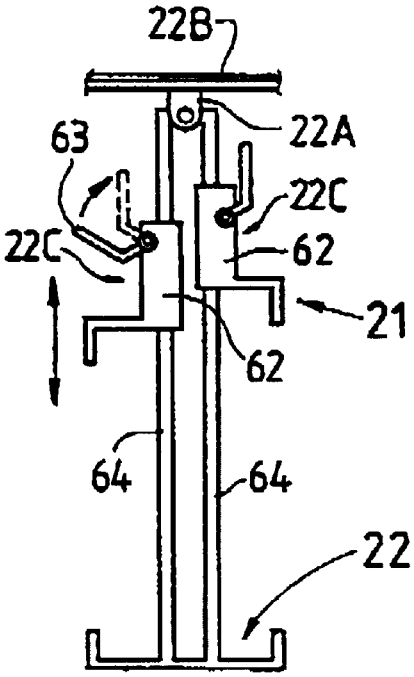

In FIG. 5*i*, in another arrangement top clamps 22 may be provided with a cam lock 62 having an operating lever 63 whereby clamp 22 may be locked in position as required when lever 63 is in the position shown in phantom. In FIG. 5*i*, top clamp 21 may be formed into two separate clamp components 22C as shown with each clamp component 22C movable along an associated shaft 64. Thus each of top clamps 22C are movable independently of each other while bottom clamps 22 are fixed. Instead of a cam lock 62 there may be used other suitable locking means such as a grub screw or locking pin as described previously.

There also may be provided tension or compression springs (not shown).

Figure 6A:
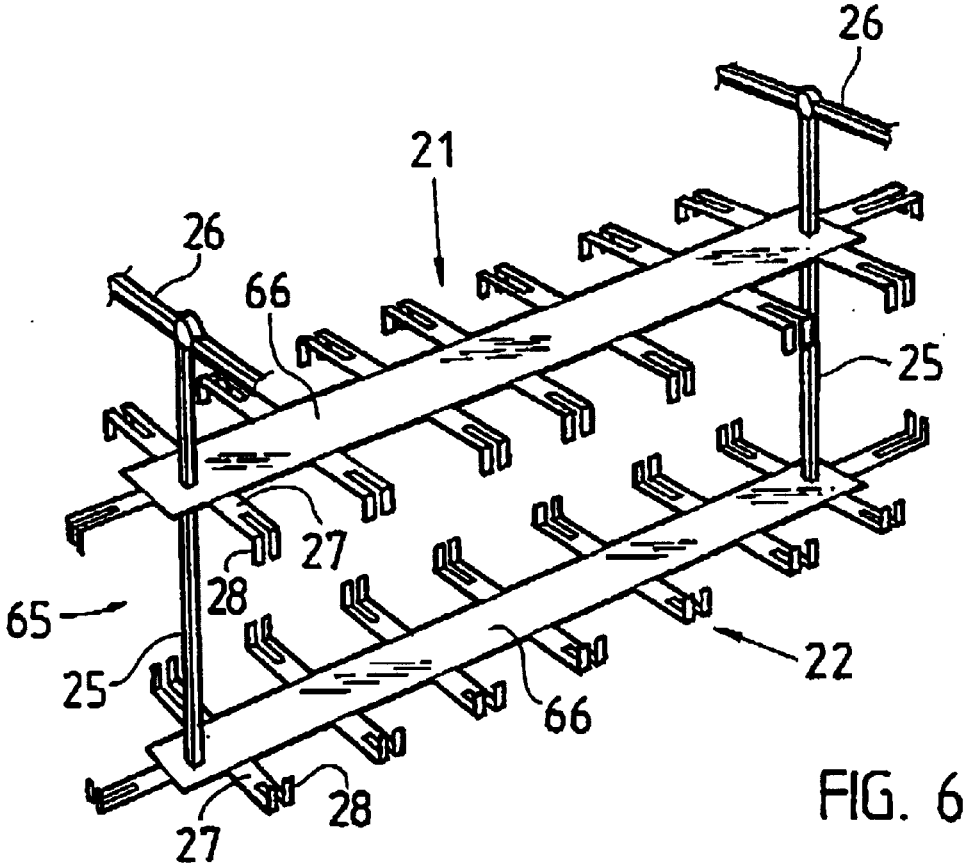
FIGS. 6*a*–6*f* represent various forms of support which may support a plurality of aluminium extrusions as shown in FIG. 1*a* simultaneously in the etching vessel, FIG. 7 represent a conveyor belt assembly for transferring aluminium extrusions of the type shown in FIG. 1 to different vats which may be utilised in a chemical milling process are hereinafter described.

In FIG. 6*a*, there may be provided a support assembly 65 which may support a plurality of aluminium extrusions 10 (not shown) each of which may be suspended from opposed arms 27 of bottom clamp assembly 21 and top clamp assembly 22. Each of arms 27 are attached to mounting plate 66.

Figure 6B:
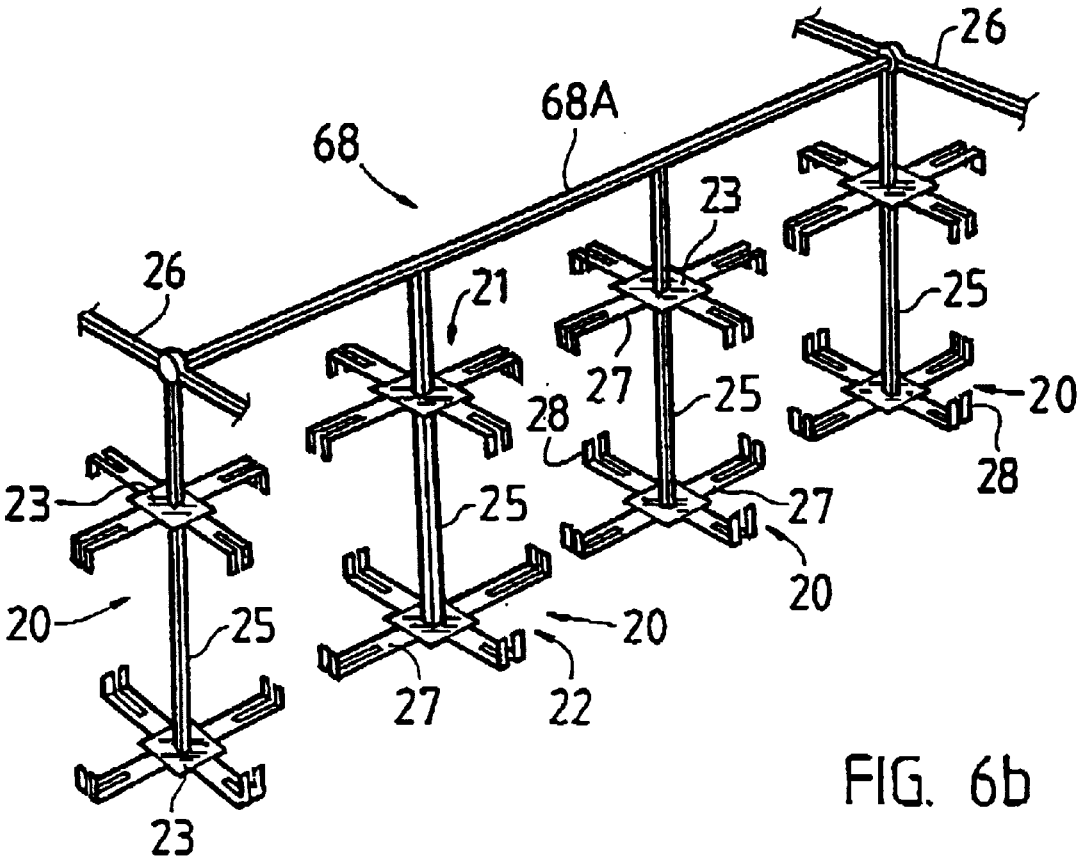

In FIG. 6*b*, there may be provided another support assembly 68 comprising a number of different supports 20 each attached to a common carrier beam 68A.

Figure 6C:
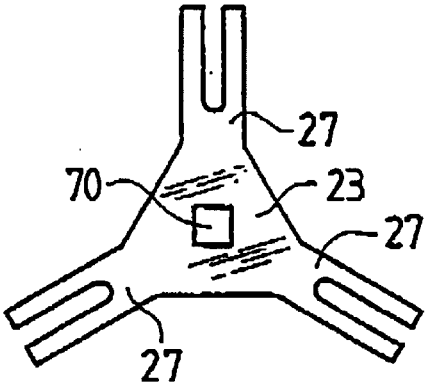
Figure 6D:
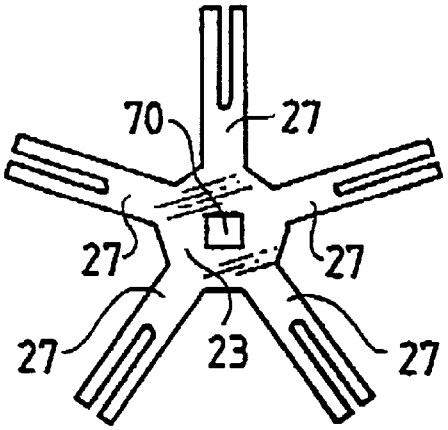

In FIGS. 6*c* and 6*d*, it will be appreciated that any number of attachment arms 27 (e.g. 3 or 5) attached to a central mounting plate 23 which may be mounted to upright rod 25 through aperture 70.

Figure 6E:
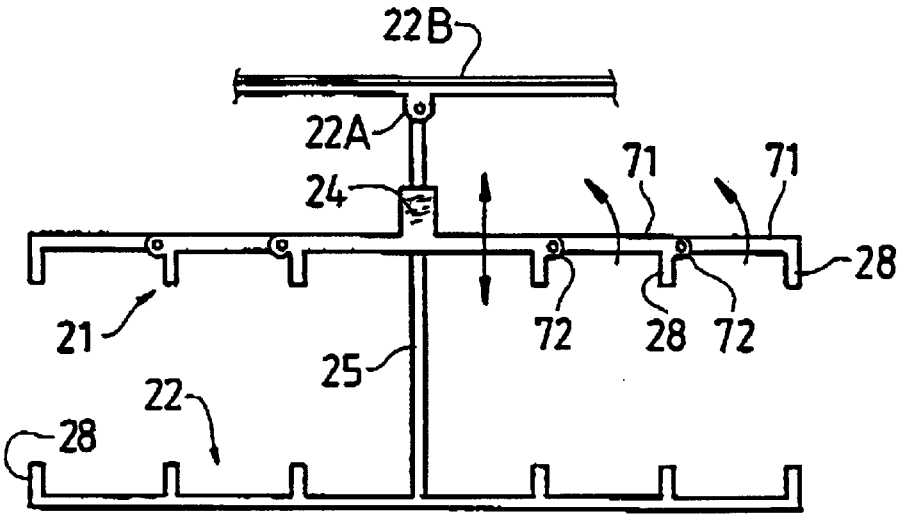

In FIG. 6*e*, there may be provided a number of clamping arms 71 which are each pivoted at 72 to an adjacent clamping arm 71. Each clamping arm 71 as shown by the arrows may be pivoted from an upper inoperative position to a lower operative position. Top clamp 21 comprising the movable clamping arms 71 is movable along rod 25 in the same fashion as discussed previously as shown by the double headed arrow. The lower clamp 22 is fixed and has a plurality of spaced clamping projections 76 as shown.

Figure 6F:
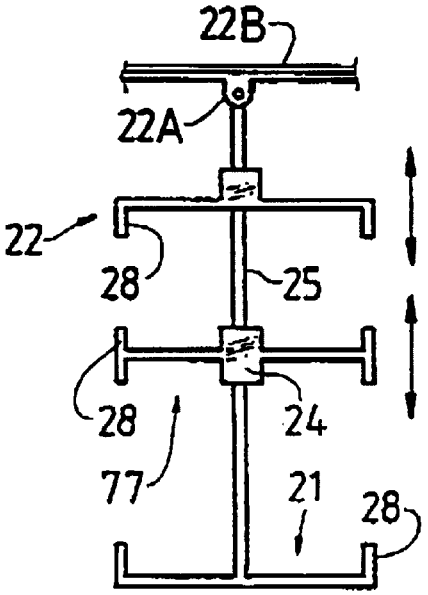

In FIG. 6*f*, a number of aluminium extrusions 10 may be stacked vertically by the use of bottom fixed clamp 21, intermediate clamp 77 and movable top clamp 22 each of which are associated with elongate rod 25.

From the foregoing, it will therefore be appreciated that chemically milled heat exchanger elements may therefore be considerably lighter in weight and wall thicknesses may be considerably reduced when compared to the wall thickness of an extruded heat exchanger element. The wall thickness of a chemically milled heat exchanger element may vary from 0.1 to 1.0 mm compared to the extruded element which may have a wall thickness of 0.8 mm or greater.

If desired, differential wall thicknesses may be used in relation to the peripheral wall 11 which may, for example, be 1 mm and the fins 16 or 17 which may each have a thickness of 0.5 mm.

The chemical milling process to which the aluminium extrusion or casting 10 may be subjected to may include the following steps:

(i) cutting or shearing the heat exchanger element to the desired length;

(ii) passing the sheared heat exchanger element through an etchant solution;

(iii) passing the etched heat exchanger element through a de-smutting or residue removing solution which may remove residue produced by corrosion or erosion of metal such as aluminium; and (iv) subsequently passing the de-smutted heat exchanger through a sealing solution which produces a chemical coating against oxidation or corrosion.

The heat exchanger element may be sheared or cut by any suitable means such as a guillotine or hand saw to the desired length which may depend on the relevant application.

Preferably before step (i), the heat exchanger element is immersed in a alkaline solution to remove contaminating surface layers such as oil, dirt or other impurities.

Subsequently the heat exchanger element may be immersed in a water rinse to remove any trace of alkaline solution.

In step (ii), the desired etchant may be a strong acid or strong base which dissolves in a controlled manner all surfaces it may come into contact with. A suitable etchant for aluminium is TURCOPORM etchant additive which may be used in combination with sodium hydroxide.

In the etching step as described above, the fluid channels if desired may be masked or blocked off so that only the fins and the external surface of the peripheral wall is etched. This may be provide for example the peripheral wall having double the wall thickness of the fins. This may be carried out when it is appreciated that the fins are being etched on both sides in comparison with the peripheral wall which is only being etched on one side. A suitable masking preparation is TURCOFORM MASK which is a hand strippable, protective coating.

Subsequently the etched heat exchanger element may be passed through a water rinse to remove all traces of etchant solution.

The cleaned heat exchanger element may then be passed through a de-smutting solution which may remove residue produced by corrosion or erosion of the metal which is suitable aluminium. The de-smutting solution may comprise an alkaline solution or detergent.

Subsequently the heat exchanger element may be passed through a water rinse to remove the de-smutting agent.

The heat exchanger element may then be passed to a sealing solution which chemically seals the surface layer of the metal (e.g. aluminium) against oxidation or corrosion. Preferably the sealing solution contains chromate ion (i.e $CrO_4$=).

The heat exchanger may then be passed through a final water rinse to remove excess sealing solution.

In both the etching step and the sealing step, the solution may be to any suitable temperature in the range of 30–90° C. The time of immersion in the etchant solution may be in the range of 1–5 minutes and, more suitably, 3 minutes dependant upon the 30 degree of etching required.

In the milling process, there may be utilised a plurality of vats or containers arranged in series or at spaced intervals wherein the heat exchanger element(s) may be passed. In one arrangement, there may be provided a conveyor having a conveyor belt or chain operated by drive rollers and idler rollers so that the chain or belt is passed through each vat. In this arrangement, an array of heat exchanger elements may be suspended from the chain at spaced intervals therealong. Each heat exchanger element may be suspended from the conveyor longitudinally, i.e. with the plurality of fins on either side of the peripheral wall all being oriented vertically.

In another alternative, there may be provided a gantry member which is located above the plurality of vats or tanks with an array of heat exchanger elements supported at spaced intervals along the length of the gantry member, e.g. by appropriate supports 20. In this alternative, the gantry member may be provided with suitable means for dropping a support 20 and its associated heat exchanger element into a selected vat. After immersion in the vat the heat exchanger may then be elevated before being immersed in the succeeding vat. Means 91 may comprise, for example, a hydraulic ram assembly or pneumatic ram assembly wherein the piston (not shown) of the hydraulic ram assembly or pneumatic ram assembly is attached to support 20. This may provide a totally compulerised or automated milling system.

The heat exchanger element of the invention, after the milling process as described above, may remove the tool hardened surface, i.e. the surface created in the extruder die which creates a barrier to heat flow. Thus the tool hardened surface may be a relatively even or smooth surface with fine serrated lines all oriented substantially parallel to each other. In comparison, the milled element will have a pitted or cratered surface appearance of greater depth than the serrated lines (e.g. of the order of three times the depth).

The rough surface to the heat exchanger element reduces laminar adhesion of fluids passing over the surface which encourages turbulent fluid flow conditions. This results in greater absorption of heat into the coolant which in many cases is air flowing through the fins of the heat exchanger element.

The milled surface also substantially increases the surface area of the heat exchanger element especially in relation to the fins. The milling process may also be regulated so as to control the degree of pitting—i.e. one can have 10 holes or pits per sq mm to 20 holes or pits per sq m.

As stated above the walls of the heat exchanger element may be reduced to a thickness of between 0.01 to 0.8 mm without sacrificing structure integrity. Ultra-thin thicknesses of 0.01 to 0.05 mm may also be produced.

The pitted surface may be regularly pitted or pitted irregularly with the pits or holes having a depth of 20 microns to 150 microns and a maximum transverse dimension of from 5 microns–150 microns.

The reduction in thickness after milling when compared to the extruder may be of the order of 99%.

Figure 7:
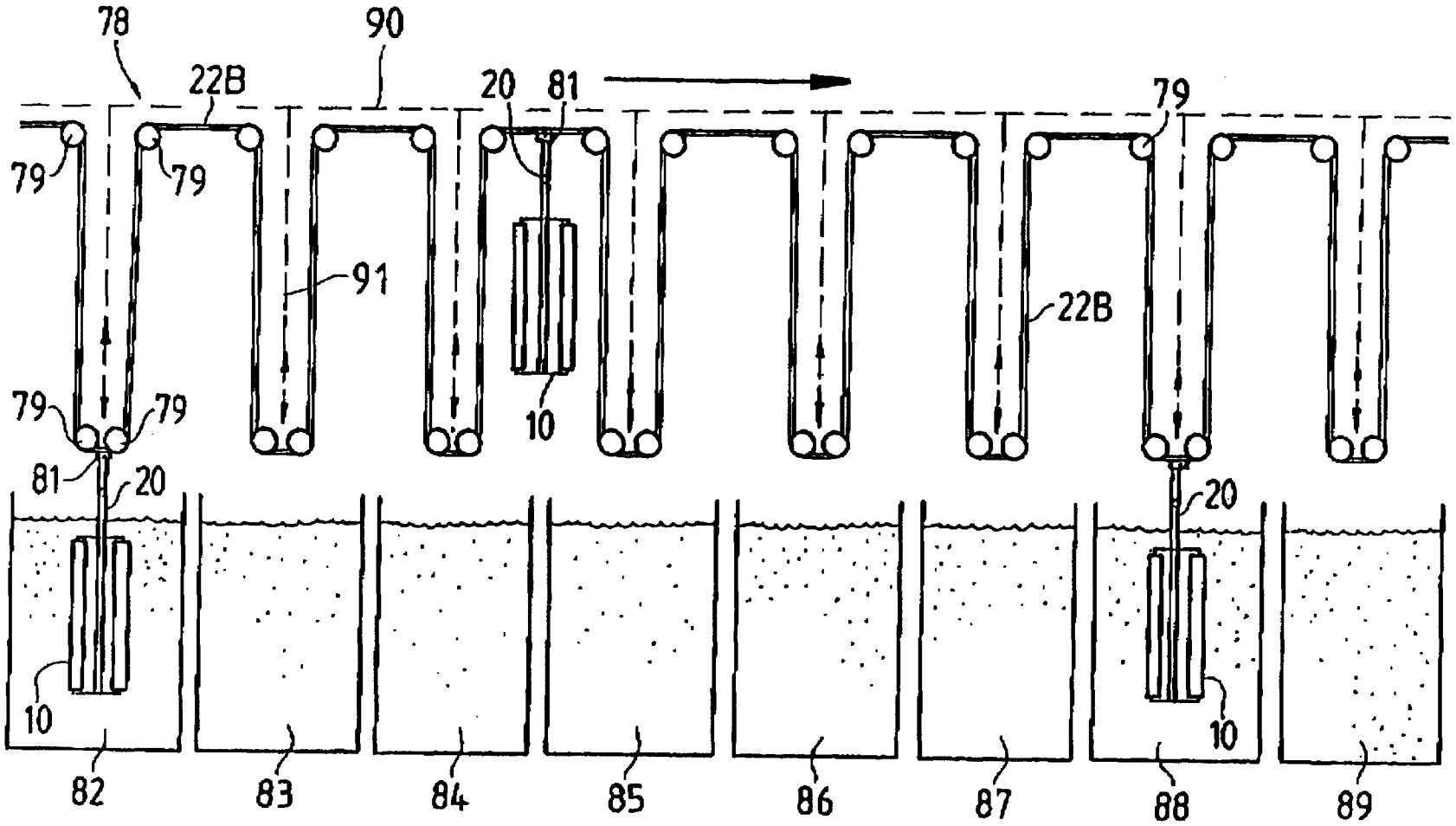

In FIG. 7, there is shown a conveyor belt assembly 78 including belt 22B supported by idler rollers 79 located at spaced intervals whereby a support 20 may be attached to belt 79 at 81 and thus enable extrusion 10 to be passed through a series of vats corresponding to the chemical milling process described above wherein vat 82 is a pre-clean vat, vat 83 corresponds to a water rinse vat, vat 84 corresponds to a etchant vessel, vat 85 corresponds to a water rinse vat, vat 86 corresponds to a de-smutting or residue removing vat, vat 87 corresponds to a water rinse vat, vat 88 corresponds to a vat containing chromate conversion solution and finally vat 89 refers to a water rinse vat.

In FIG. 7 shown in phantom, reference is also made to the alternative embodiment of the gantry member described above, The gantry member is indicated by reference numeral 90 and there is also provided reciprocatable means 91 for raising and lowering the support 20. Such reciprocatable means may comprise, for example, a hydraulic ram assembly or pneumatic ram assembly. In either of these embodiments, support 20 may be attached to a piston (not shown) of the hydraulic ram assembly or pneumatic ram assembly.

Figure 8:
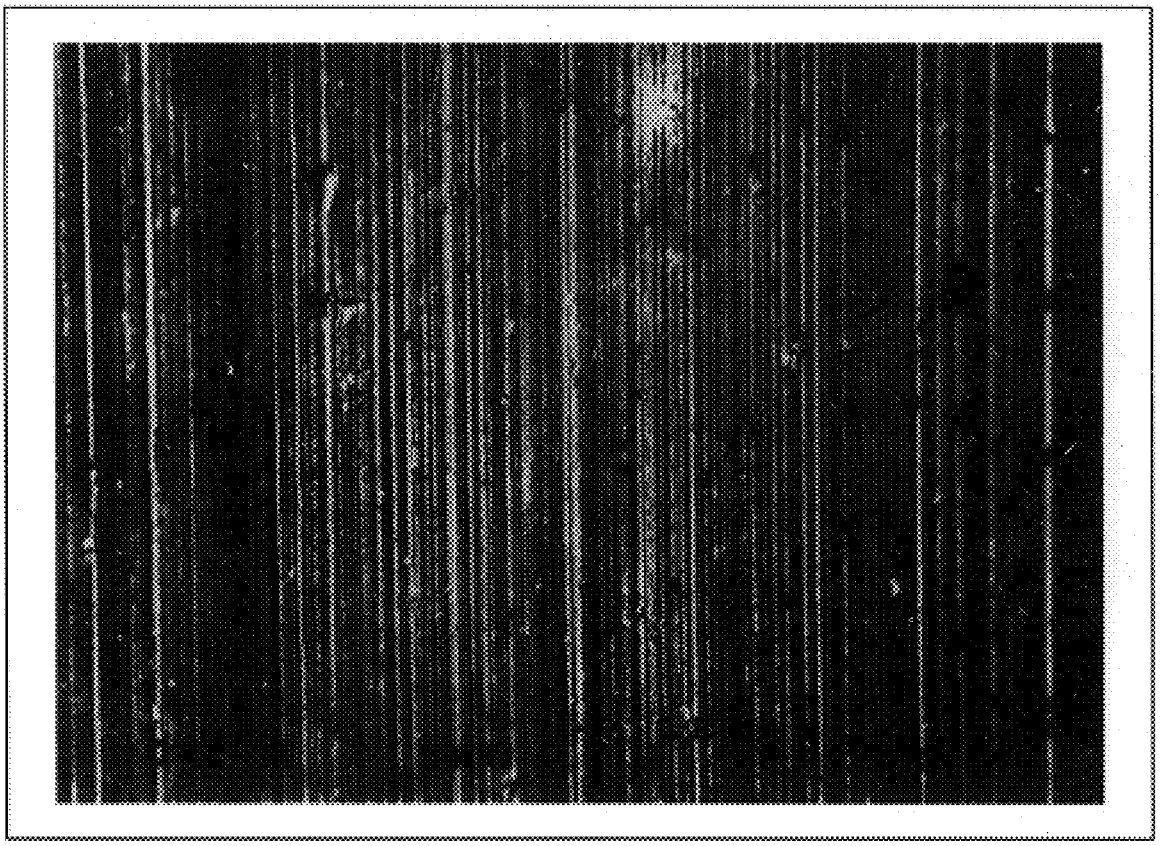
FIG. 8 is a micrograph showing part of the structure of a heat exchanger element after extrusion and prior to being subjected to the chemical milling process of the invention.

In relation to micrographs of the heat exchanger element before the element has been chemically milled by the process of the invention, it will be noted that such heat exchanger element comprises a series of substantially parallel lines as indicated after passage through an extrusion die. These lines may range from 1 micron to 40 microns in width. A sample micrograph is shown in FIG. 8.

Figure 9:
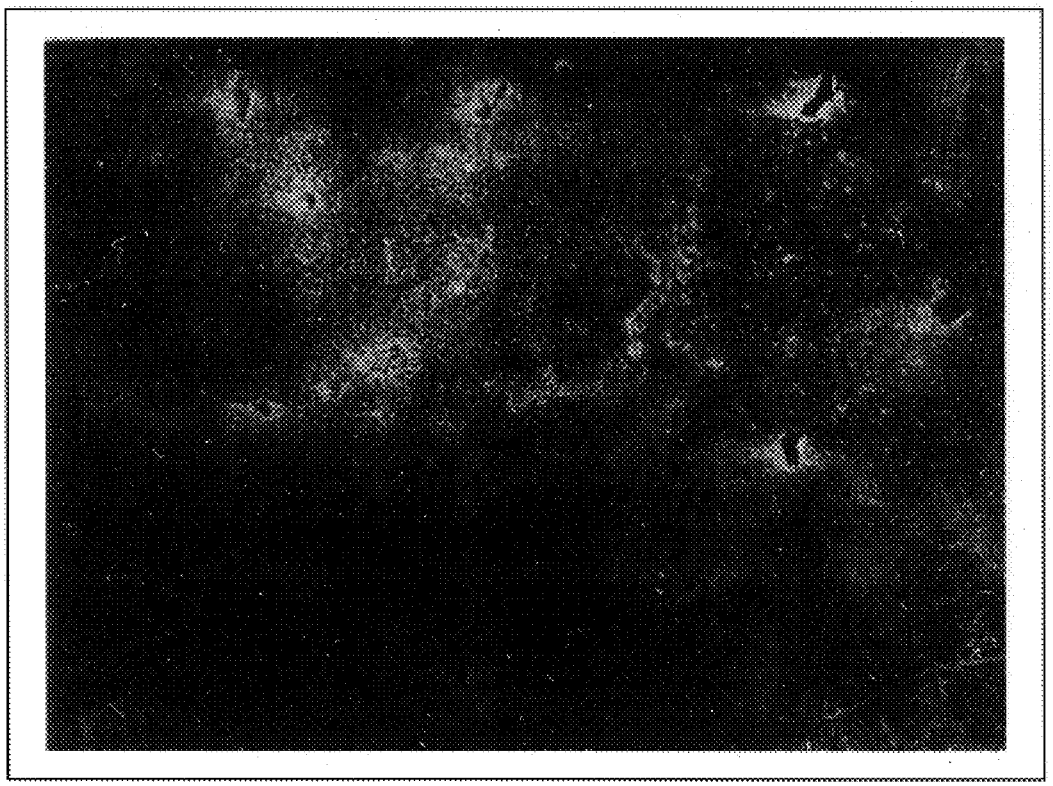
FIG. 9 is a micrograph showing part of the structure of a heat exchanger element constructed in accordance with the chemical milling process of the invention and which has been subjected to acid etching.
Figure 10:
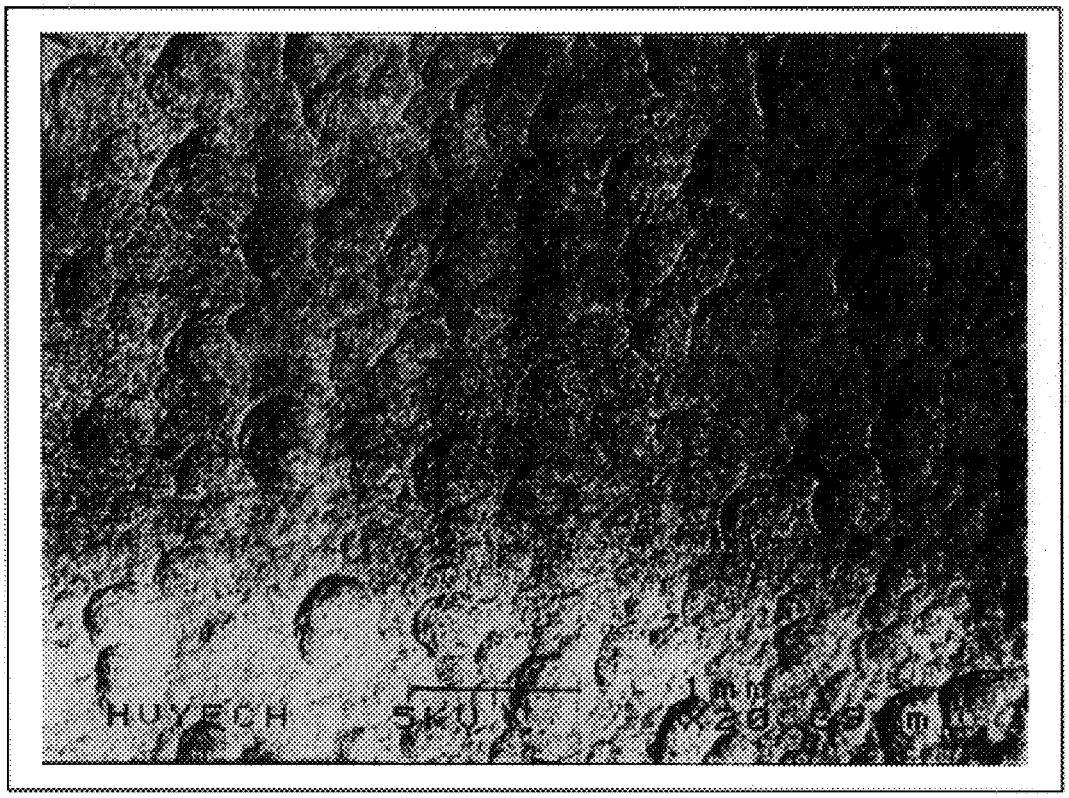
FIG. 10 is a micrograph showing part of the structure of a heat exchanger element constructed in accordance with the chemical milling process of the invention and which has been subjected to alkaline etching.

In relation to the heat exchanger element which has been subjected to an acid etch by the process of the inventions it will be noted that the surface comprises a series of finely textured hills and valleys with there being 3–300 hills or valleys per square millimetre. The hills or valleys may also have an average of 0.1 mm in depth. A sample micrograph is shown in FIG. 9. In relation to an alkaline etch of a heat exchanger element achieved by the process of the invention, there is shown a far more coarser structure of hills and valleys with there being provided 1 to 200 hills or valleys to the sq mm. Each of these hills and valleys may also have an average of 0.2 mm depth. A sample micrograph is shown in FIG. 10.

From the foregoing therefore, it will be appreciated that the invention the texture or structure of the heat exchanger element after being processed by the milling process of the invention may have its texture pre-determined according to a particular desired application.

The texture may be controlled by the temperatures attained in the etchant vat. Thus, for example, for relatively low pressure applications one would require a coarser texture and this would have applicability in applications such as vehicle radiators.

On the other hand, for high pressure applications, one would require a finer structural texture and this could apply to condensers for air conditioning and refrigeration for example.

In this regard, it will be appreciated that a coarser texture means a lesser number of hills or valleys per sq cm and a finer texture means a greater number of hills or valleys per sq mm.

I claim:

1. A non-buoyant support for suspending an extrusion or casting in an etching solution so as to retain the extrusion or casting in a fully submerged position in said etching solution, said extrusion or casting comprising a heat exchanger element having a peripheral wall defining a plurality of open-ended fluid channels separated by webs or partitions, and there also being provided an array of fins extending outwardly from the peripheral wall, said non-buoyant support comprising a top clamping assembly and a bottom clamping assembly which are relatively movable towards each other, wherein each of the top clamnping assembly and the bottom clamping assembly has one or more offset projections configured to engage with said fluid channels or configured to engage between adjacent fins at adjacent ends of the heat exchanger element.

2. The non-buoyanit support as claimed in claim 1 wherein the top clamping assembly and the bottom clamping assembly each includes a pair of offset projections in opposed relationship.

3. The non-buoyant support as claimed in claim 2 including an elongate rod interconnecting the top clamping assembly and the bottom clamping assembly.

4. The non-buoyant support as claimed in claim 3 wherein the top clamping assembly and/or the bottom clamping assembly includes a plurality of mounting arms extending outwardly from said elongate rod.

5. The non-buoyant support as claimed in claim 4 wherein each of said mounting arms includes one or more of said offset projections.

6. The non-buoyant support as claimed in claim 4 wherein one of said top clamping assembly or said bottom clamping assembly is adjustably mounted to said elongate rod.

7. The non-buoyant support as claimed in claim 6 wherein said adjustably mounted clamping assembly includes a central hub or sleeve which is releasably attached to the elongate rod.

8. The non-buoyant support as claimed in claim 6 wherein one of said top clamping assembly or said bottom clamping assembly is rotatably movable relative to said elongate rod.

9. The non-buoyant support as claimed in claim 6 wherein said elongate rod has a handle attached thereto above said upper clamping assembly.

10. The non-buoyant support as claimed in claim 6 wherein said clamping assembly adjustable mounted to said elongate rod is provided with releasable locking means for locking said clamping assembly to said elongate rod.

11. The non-buoyant support as claimed in claim 6 wherein said top clamping assembly is adjustably mounted to said elongate rod and said bottom clamping assembly is rigidly attached to said elongate rod.

12. The non-buoyant support as claimed in claim 1 including a plurality of elongated rods spaced from each other and having a corresponding top clamping assembly and bottom clamping assembly attached thereto.

13. The non-buoyant support as claimed in claim 1 wherein each of the top clamping assembly and the bottom clamping assembly includes a mounting plate having a plurality of mounting arms attached to a peripheral part thereof, one of more of the offset projections extending from each mounting arm.

14. The non-buoyant support as claimed in claim 1 including a plurality of elongate rods spaced from each other which are all attached to a carrier beam and wherein each of said elongate rods supports a top clamping assembly and a bottom clamping assembly.

15. A support for suspending an extrusion or casting in an etching solution, the support comprising:

(a) an elongated shaft;

(b) a top clamping assembly disposed on the elongated shaft, the top clamping assembly including a top arm outwardly projecting from the shaft and a finger projecting from the top arm in substantially parallel alignment with the shaft; and (c) a bottom clamping assembly disposed on the elongated shaft, the bottom clamping assembly including a bottom arm outwardly projecting from the shaft and a finger projecting from the bottom arm in substantially parallel alignment with the shaft, the finger of the bottom arm being substantially aligned with and facing the finger of the top arm, at least one of the top clamping assembly and bottom clamping assembly being movable relative to the other.

16. The support as recited in claim 15, wherein the top clamping assembly further comprises a plurality of arms outwardly projecting from the shaft and a finger projecting from each of the plurality of arms, each finger projecting in substantially parallel alignment with the shaft.

17. The support as recited in claim 16, wherein each of said plurality of arms has a pair of spaced apart fingers projecting therefrom.

18. The assembly as recited in claim 15, further comprising means for mechanically drawing together the top clamping assembly and the bottom clamping assembly under a biasing force.

19. An assembly comprising:

(a) an elongated heat exchanger element having a peripheral wall defining a plurality of open-ended fluid channels separated by partitions, a plurality of fins outwardly projecting from the peripheral wall, the fins extending from a first end to an opposing second end in substantially parallel alignment with the fluid channels; and (b) a support comprising an elongated shaft having disposed thereon a top clamping assembly configured to engage the first end of the heat exchanger element and a bottom clamping assembly configured to engage the second end of the heat exchanger element, at least one of the top clamping assembly and the bottom clamping assembly being movable relative to the other to enable selective clamping of the heat exchanger element therebetween.

20. The assembly as recited in claim 19, wherein at least one of the top clamping assembly and the bottom clamping assembly comprises an arm outwardly projecting from the shaft and a finger projecting from the arm, the finger projecting in substantially parallel alignment with the shaft.

21. The assembly as recited in claim 19, wherein at least one of the top clamping assembly and the bottom clamping assembly further comprises a plurality of discrete, spaced apart arms radially outwardly projecting from the shaft and a finger projecting from each of the plurality of arms, each finger projecting in substantially parallel alignment with the shaft.

22. The assembly as recited in claim 21, wherein each of the arms has a pair of spaced apart fingers projecting therefrom.

23. The assembly as recited in claim 19, wherein the support further comprises means for mechanically drawing together the top clamping assembly and the bottom clamping assembly so as to enable the heat exchanger to be selectively clamped therebetween under a biasing force.

* * * * *

UNITED STATES PATENT AND TRADEMARK OFFICE

CERTIFICATE OF CORRECTION

PATENT NO. : 5,961,771

DATED : Oct. 5, 1999

INVENTOR(S) : Milne Jurisich

It is certified that error appears in the above-identified patent and that said Letters Patent are hereby corrected as shown below:

Col. 3, line 63, after "provided" insert --with--

Col. 4, line 9, after "and" change "suitably" to --suitable--

Col. 4, line 49, after "7" change "represent" to --represents--

Col. 4, line 52, after "process" change "are" to --that is--

Col. 5, line 9, after "FIG." change "2" to --1b--

Col. 5, line 17, after "pin" change "24" to --24A--

Col. 5, line 20, after "26" insert a period

Col. 5, line 22, after "28" insert a period

Col. 5, line 43, after "by" change "gap." to --gap--

Col. 5, line 62, after "in" change "PIG." to --FIG.--

Col. 6, line 39, after "clamps" change "22" to --21--

Col. 6, line 42, change "clamp 22" to --clamps 21--

Col. 6, line 46, after "clamps" change "22C" to --21--

Col. 6, line 49, after "previously" delete the paragraph break

UNITED STATES PATENT AND TRADEMARK OFFICE

CERTIFICATE OF CORRECTION

PATENT NO. : 5,961,771

DATED : Oct. 5, 1999

INVENTOR(S) : Milne Jurisich

It is certified that error appears in the above-identified patent and that said Letters Patent are hereby corrected as shown below:

Col. 6, line 55, after "assembly" change "21" to --22--

Col. 6, line 56, after "assembly" change "22" to --21--

Col. 7, line 9, after "clamp" change "21" to --22--

Col. 7, line 10, after "clamp" change "22" to --21--

Col. 7, line 43, after "in" change "a" to --an--

Col. 7, line 51, after "is" change "TURCOPORM" to --TURCOFORM--

Col. 7, line 56, after "may" delete "be"

Col. 8, line 17, after "the" delete "30"

Col. 8, line 43, after "totally" change "compulserised" to --computerized--

Col. 8, line 64, after "above" insert a comma

Col. 9, line 10, after "belt" change "79" to --22B--

Col. 9, line 14, after "to" change "a" to --an--

Col. 9, line 22, change "above," to --above.--

Col. 9, line 51, after "invention" insert a comma

UNITED STATES PATENT AND TRADEMARK OFFICE

CERTIFICATE OF CORRECTION

PATENT NO. : 5,961,771

DATED : Oct. 5, 1999

INVENTOR(S) : Milne Jurisich

It is certified that error appears in the above-identified patent and that said Letters Patent are hereby corrected as shown below:

Col. 10, line 12, after "top" change "clamnping" to --clamping--

Col. 10, line 44, after "assembly" change "adjustable" to --adjustably--

Col. 10, line 59, after "one" change "of" to --or--

Signed and Sealed this

Third Day of April, 2001

*Attest:*

Nicholas P. Godici

NICHOLAS P. GODICI

*Attesting Officer*

*Acting Director of the United States Patent and Trademark Office*